US009393664B2

(12) United States Patent
Han et al.

(10) Patent No.: US 9,393,664 B2
(45) Date of Patent: Jul. 19, 2016

(54) AUTOMATIC SHEET GRINDING APPARATUS

(71) Applicant: KOREA INSTITUTE OF GEOSCIENCE AND MINERAL RESOURCES, Daejeon (KR)

(72) Inventors: Rae-Hee Han, Seoul (KR); Ki-Sung Sung, Incheon (KR); Jeong-Chan Kim, Daejeon (KR)

(73) Assignee: KOREA INSTITUTE OF GEOSCIENCE AND MINERAL RESOURCES, Daejeon (KR)

( * ) Notice: Subject to any disclaimer, the term of this patent is extended or adjusted under 35 U.S.C. 154(b) by 32 days.

(21) Appl. No.: 14/577,877

(22) Filed: Dec. 19, 2014

(65) Prior Publication Data

US 2015/0298276 A1 Oct. 22, 2015

(30) Foreign Application Priority Data

Apr. 22, 2014 (KR) ..... 10-2014-0047915

(51) Int. Cl.
*B24B 49/00* (2012.01)
*B24B 7/07* (2006.01)
(Continued)

(52) U.S. Cl.
CPC . *B24B 7/07* (2013.01); *B24B 49/02* (2013.01); *B24B 57/04* (2013.01)

(58) Field of Classification Search
CPC ..... B24B 7/07; B24B 49/02; B24B 57/04
USPC ..... 451/5–10, 73
See application file for complete search history.

(56) References Cited

U.S. PATENT DOCUMENTS 3,857,200 A * 12/1974 Hill ..... B24B 49/18 451/56
3,965,622 A * 6/1976 Stepanek ..... B24B 47/20 451/26

(Continued)

FOREIGN PATENT DOCUMENTS

JP 02-110309 A 4/1990
JP 05220659 A * 8/1993

(Continued)

OTHER PUBLICATIONS

Japanese Notice of Allowance with English Translation for Application No. 2014-248838, dated for Jul. 14, 2015, 6 pages.

(Continued)

*Primary Examiner* — George Nguyen
(74) *Attorney, Agent, or Firm* — Lewis Roca Rothgerber Christie, LLP

(57) ABSTRACT

An automatic sheet grinding apparatus includes a stationary stage positioned at a lower portion of the automatic sheet grinding apparatus, a sheet holder positioned on the stationary stage to grip the sheet, and a grinding head part having a chuck assembly fixed to the grinding head part through a spindle, spaced apart from the sheet holder, positioned on the stationary stage, and having a grinding disc attached to the chuck assembly to grind the sheet provided in the sheet holder. The grinding head part includes a thickness measuring unit to measure a thickness of the sheet, and a hardness measuring unit to measure hardness of the sheet. The automatic sheet grinding apparatus further includes rails positioned on the stationary stage and extending in parallel to each other. In this case, the sheet holder is securely and movably provided on the rails positioned on the stationary stage to grip the sheet.

15 Claims, 5 Drawing Sheets

(51) Int. Cl.
*B24B 49/02* (2006.01)
*B24B 57/04* (2006.01)

(56) References Cited

U.S. PATENT DOCUMENTS 4,498,778 A * 2/1985 White ..... G01B 11/25 348/94
4,601,134 A * 7/1986 Hessemann ..... B24B 21/06 451/300
4,741,621 A * 5/1988 Taft ..... G01B 11/25 348/128
4,839,994 A * 6/1989 Heesemann ..... B24B 49/10 356/606
5,146,779 A * 9/1992 Sugimoto ..... G01N 3/40 356/626
5,282,382 A * 2/1994 Fiore ..... G01N 3/48 162/198
6,071,177 A * 6/2000 Lin ..... B24B 37/013 156/345.13
6,234,871 B1 * 5/2001 Chaloupek ..... B24B 7/12 451/11
6,319,093 B1 * 11/2001 Lebel ..... B24B 37/013 451/41
6,328,636 B1 * 12/2001 Yoshimi ..... B23Q 11/1053 451/443
6,755,075 B2 * 6/2004 Nagashima ..... B82Y 35/00 73/105
7,194,896 B2 * 3/2007 Kaneko ..... G01N 33/025 73/81
8,496,510 B2 * 7/2013 Miyamoto ..... B24B 5/366 451/5
2004/0149690 A1 * 8/2004 Hsieh ..... B24B 37/013 216/84
2004/0259475 A1 * 12/2004 Vianello ..... B24B 9/102 451/5
2005/0121141 A1 * 6/2005 Manens ..... B24B 37/013 156/345.15
2006/0226584 A1 * 10/2006 Maeda ..... C21D 1/09 266/104
2009/0061737 A1 * 3/2009 Sudo ..... B24B 37/042 451/28
2009/0093202 A1 * 4/2009 Fukuda ..... B24B 37/22 451/533
2010/0185314 A1 * 7/2010 Xu ..... B24B 37/005 700/109
2015/0017880 A1 * 1/2015 Nomura ..... H01L 22/26 451/5
2015/0364389 A1 * 12/2015 Fukushima ..... H01L 22/26 438/5

FOREIGN PATENT DOCUMENTS

JP 2002-066883 A 3/2002
JP 2008-232825 A 10/2008
KR 20-2009-0001556 2/2009
KR 10-2009-0044323 A 5/2009
KR 10-2012-0123082 A 11/2012

OTHER PUBLICATIONS

Korean Office action with English Translation for Application No. 10-2014-0047915, dated Jul. 23, 2015, 12 pages.

* cited by examiner

AUTOMATIC SHEET GRINDING APPARATUS

CROSS-REFERENCE TO RELATED APPLICATION

This application claims the benefit under 35 U.S.C. §119 of Korean Patent Application No. 10-2014-0047915 filed on Apr. 22, 2014 in the Korean Intellectual Property Office, the entirety of which disclosure is incorporated herein by reference.

BACKGROUND OF THE INVENTION

1) Field of the Invention

The present invention relates to a sheet grinding apparatus. More specifically, the present invention relates to an automatic sheet grinding apparatus having a simple structure representing superior durability when grinding the sheet. Especially, the automatic sheet grinding apparatus can automatically grind the sheet so that a person needs not stand by during the grinding work.

2) Background of Related Art

A sheet grinding scheme refers to a procedure of grinding various metallic samples, a semiconductor device sample, a geological sample, such as a core sample obtained from a borehole, or other plastic samples to sheets.

The sheet grinding scheme may be used as a base technology to detect optical characteristics or crystalline structures of various samples. The optical characteristics may be detected by a microscope, for example an optical microscope, such as a polarizing microscope, and an electronic microscope, such as a scanning electron microscope (SEM), transmission electron microscopy (TEM), or atomic force microscopy (AFM), and the other crystalline structures may be detected through appropriate physical and chemical treatment.

Meanwhile, in the related art, a grinding apparatus similar to that disclosed in patent document 1 (Korean Unexamined Utility Model Publication No. 20-2009-0001556 (published on Feb. 18, 2009) titled "Grinder for Grinding Sample") has been generally known.

Conventionally, in the case of a grinding apparatus to force a worker to grip a sheet until the sheet having an appropriate thickness is formed, since the worker must keep the position of the worker, the worker cannot perform another work when the sheet is ground.

Further, in the case of a partially automatic grinding apparatus, a timer is mounted in the grinding apparatus, so that the time required for a grinding work can be easily detected, and the conduction of the grinding work till predetermined time can be easily controlled. However, the time required for the grinding work cannot be previously estimated before the grinding work is performed.

SUMMARY OF THE INVENTION

The present invention is made in order to solve the above problems occurring in the related art, and an object of the present invention is to provide an automatic sheet grinding apparatus so that a worker needs not stand by during a grinding work.

Another object of the present invention is to provide an automatic sheet grinding apparatus capable of estimating and displaying time required for a grinding work before the grinding work for the sheet is started.

The present invention suggests several objects without limitation to the above object(s), and other object(s), which are not described, can be clearly comprehended from the following description by those skilled in the art which the present invention pertains.

In order to accomplish the above object of the present invention, there is provided an automatic sheet grinding apparatus. The automatic sheet grinding apparatus includes a stationary stage positioned at a lower portion of the automatic sheet grinding apparatus, a sheet holder positioned on the stationary stage to grip the sheet, and a grinding head part having a chuck assembly fixed to the grinding head part through a spindle, spaced apart from the sheet holder, positioned on the stationary stage, and having a grinding disc attached to the chuck assembly to grind the sheet provided in the sheet holder. The grinding head part includes a thickness measuring unit to measure a thickness of the sheet, and a hardness measuring unit to measure hardness of the sheet.

Preferably, the sheet has a shape of a circle or a rectangle, and the sheet holder has a shape of a circle or a rectangle corresponding to the shape of the sheet.

In addition, preferably, the sheet holder includes at least three holder gripping parts to grip the sheet.

Further, the sheet holder is provided at a center thereof with a concave part, and the concave part has a depth lower than a height of the sheet.

According to another aspect of the present invention, there is provided an automatic sheet grinding apparatus. The automatic sheet grinding apparatus includes a stationary stage positioned at a lower portion of the automatic sheet grinding apparatus, rails positioned on the stationary stage and extending in parallel to each other, a sheet holder securely and movably provided on the rails positioned on the stationary stage to grip the sheet, and a grinding head part having a chuck assembly fixed to the grinding head part through a spindle, spaced apart from the sheet holder, positioned on the stationary stage, and having a grinding disc attached to the chuck assembly to grind the sheet provided in the sheet holder. The grinding head part includes a thickness measuring unit to measure a thickness of the sheet, and a hardness measuring unit to measure hardness of the sheet.

Preferably, the sheet has a shape of a circle or a rectangle, and the sheet holder has a shape of a circle or a rectangle corresponding to the shape of the sheet.

In addition, preferably, the sheet holder includes at least three holder gripping parts to grip the sheet.

Further, the sheet holder is provided at a center thereof with a concave part, and the concave part has a depth lower than a height of the sheet.

Preferably, the grinding head part further includes a display unit to display a measurement result by the thickness measuring unit and a measurement result by the hardness measuring unit.

In addition, the display unit of the grinding head part includes a time display unit to display total time estimated to grind the sheet, or total time required to grind the sheet.

Preferably, the automatic sheet grinding apparatus further includes a water or oil feeding unit to control heat emitted when the sheet is ground, or a feeding unit to feed grinding powders.

Preferably, the sheet holder securely and movably provided on the rails moves left or right when the thickness or the hardness of the sheet is measured.

Details of other embodiments are included in the detailed description and the accompanying drawings.

The advantages, the features, and schemes of achieving the advantages and features will be apparently comprehended by those skilled in the art based on the embodiments, which are detailed later in detail, together with accompanying drawings. The present invention is not limited to the following embodiments but includes various applications and modifications. The embodiments will make the disclosure of the present invention complete, and allow those skilled in the art to completely comprehend the scope of the present invention.

As described above, according to the method of synthesizing the hollow silica using the sodium silicate, the hollow silica particles having the size of several micrometers can be fabricated while using low-price sodium silicate instead of conventional high-price TEOS.

In addition, the detailed descriptions of well-known techniques incorporated herein may be omitted when they make the subject matter rather unclear.

As described above, according to an exemplary embodiment of the present invention, time to be unnecessarily wasted to grind the sheet can be saved because the worker may not keep the position of the worker when the sheet is ground.

In addition, according to another exemplary embodiment of the present invention, the time required to grind the sheet can be estimated before the grinding work for the sheet is started. Accordingly, when the grinding work for the sheet is finished and another work is performed, the convenience of the work can be increased.

DETAILED DESCRIPTION OF THE INVENTION

Hereinafter, the embodiment of the present invention will be described in detail with reference to accompanying drawings.

Figure 1:
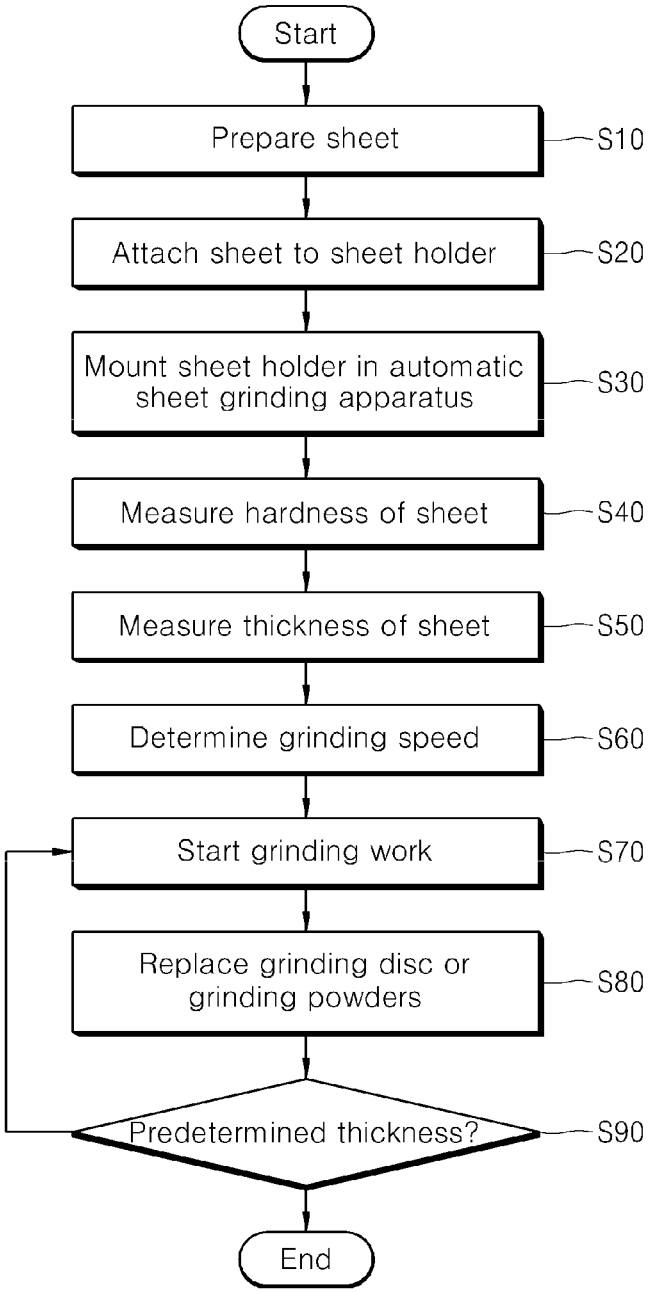
FIG. 1 is a flowchart schematically showing a method of grinding a sheet in an automatic sheet grinding apparatus according to an exemplary embodiment of the present invention.

FIG. 1 is a flowchart schematically showing a procedure of grinding a sheet in an automatic sheet grinding apparatus according to an exemplary embodiment of the present invention.

Referring to FIG. 1, the procedure of grinding the sheet in an automatic sheet grinding apparatus according to an exemplary embodiment of the present invention includes a step of preparing a sheet (S10), a step of attaching the sheet to a sheet holder (S20), a step of mounting the sheet holder in the automatic sheet grinding apparatus (S30), a step of measuring the hardness of the sheet (S40), a step of measuring a thickness of the sheet (S50), a step of determining a grinding speed (S60), a step of starting a grinding work (S70), a step of replacing a grinding disc or grinding powders (S80), and a step of determining if a grounded sheet has a predetermined thickness (S90).

First, according to the step of preparing the sheet (S10), a sheet serving as a primary material used before the final sheet is prepared in the automatic sheet grinding apparatus according to the exemplary embodiment of the present invention.

The sheet prepared in the present step may have a significantly thick thickness different from a sheet obtained as a final product, that is, a sheet obtained in the step S90.

In addition, the expression "a sheet used in the present invention" is made to represent a specimen or a sample for the convenience of explanation, and the sheet before a grinding work is started may have a thick thickness. In addition, the sheet prepared in the present step (S10) refers to a starting material to prepare the sheet serving as the final product.

Accordingly, the initial sheet is changed into the final sheet as the grinding work is performed.

Next, according to the step of attaching the sheet to the sheet holder (S20), the sheet obtained in the right previous step (S10) is attached to the sheet holder.

The sheet may be attached to the sheet holder using an adhesive agent. Preferably, the sheet may be attached to the sheet holder using a holder griping part.

Then, according to the step of mounting the sheet holder in the automatic sheet grinding apparatus (S30), the sheet holder is mounted in the automatic sheet grinding apparatus. The sheet holder may be simply placed on a stage of the automatic sheet grinding apparatus. Preferably, the sheet holder may be movably fixed and positioned onto a rail 265 (see FIG. 2) to be described according to an exemplary embodiment of the present invention.

Thereafter, according to the step of measuring the hardness of the sheet (S40), the hardness of the sheet provided to the automatic sheet grinding apparatus is measured. In addition, according to the step of measuring the thickness of the sheet (S50), the thickness of the sheet provided to the automatic sheet grinding apparatus is measured.

In this case, the step of measuring the hardness of the sheet (S40) and the step of measuring the thickness of the sheet (S50) may be simultaneously performed instead of being sequentially performed. In addition, the step of measuring the thickness of the sheet (S50) may be performed before the step of measuring the hardness of the sheet (S40) is performed.

The step of measuring the hardness of the sheet (S40) and the step of measuring the thickness of the sheet (S50) are performed to previously detect the hardness and the thickness of the sheet before the final sheet is prepared by grinding the sheet provided in the automatic sheet grinding apparatus. The steps (S40 and S50) may be steps to collect basic data used in the subsequent steps.

Regarding the hardness, various types of hardness may be measured. For example, the hardness value, such as HV, HB, HRB, or HRC, may be measured.

In this case, a worker may input the thickness of the final thickness, or may input data representing a grinding degree of the sheet.

In the case that the worker inputs the data representing the grinding degree of the sheet, the sheet having a significantly thick thickness may be partially ground and removed.

Subsequently, according to the step of determining the grinding speed (S60), the grinding speed to grind the sheet under the optimal condition is determined based on the basic data obtained in the right previous step.

According to the present step (S60), the types of the grinding discs classified based on meshes marked by 200, 400, and 600 can be notified to the worker. In other words, the sheet having higher hardness may be allocated with a grinding disc having a smaller mesh number. The soft sheet, such as unconsolidated sample, having lower hardness, may be allocated with a grinding disc having a larger mesh number.

Meanwhile, preferably, the grinding disc is subject to diamond treatment in order to improve the endurance of the grinding disc.

Similarly, even if the grinding powders are used instead of the grinding disc, the sheet having the higher hardness may be allocated with grinding powders having the smaller mesh number, and the sheet having the lower hardness may be allocated with grinding powders having the larger mesh number.

Next, in the step of starting the grinding work (S70), the sheet is literally started to be ground.

Figure 2:
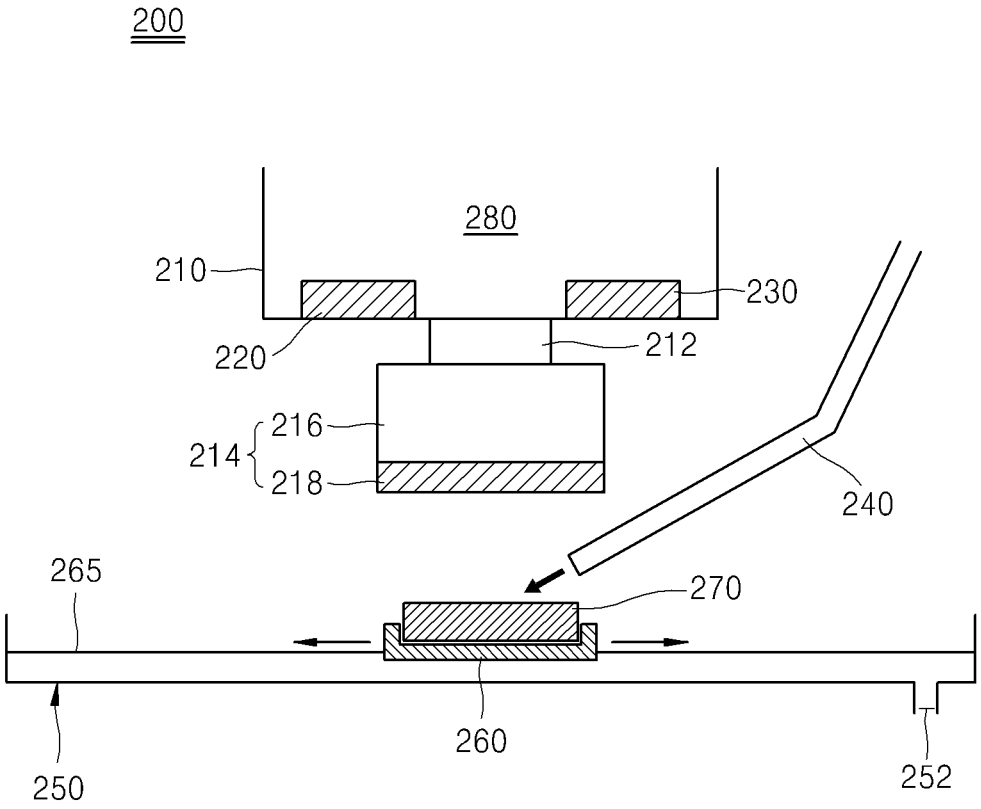
FIG. 2 is a side sectional view showing the automatic sheet grinding apparatus according to an exemplary embodiment of the present invention.
Figure 3:
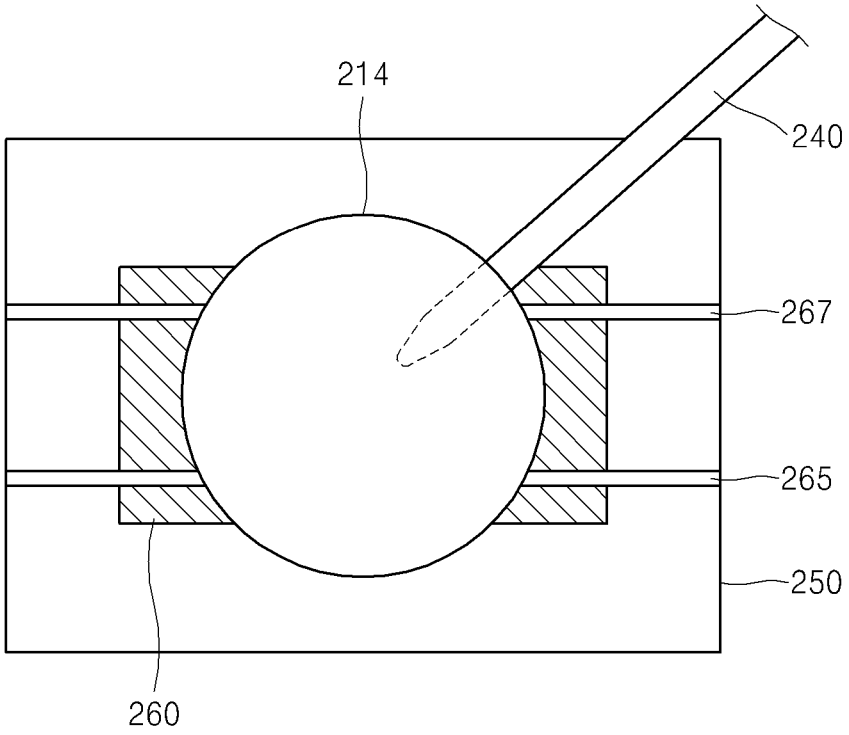
FIG. 3 is a plan view showing the automatic sheet grinding apparatus shown in FIG. 2 according to an exemplary embodiment of the present invention.

In this case, the grinding work may be performed by rotating the grinding disc. Alternatively, as shown in FIGS. 2 and 3, the sheet holder may be ground while reciprocating left or right on the rail.

Next, according to the step of replacing the grinding disc or the grinding powders (S80), the sheet is ground while the thickness or the hardness of the sheet is periodically measured, so that the ground disc or the grinding powders are replaced at a proper moment.

According to the present invention, although description has been made regarding that one grinding head part is formed for the illustrative purpose and the convenience of explanation, there may be provided a plurality of grinding head parts to which the grinding discs having mutually different meshes are attached.

Therefore, when the grinding work is started, the grinding disc having the smaller mesh number is used. As the grinding work is in progress, the grinding disc having the larger mesh number may be replaced for the use thereof if necessary.

In addition, according to the present invention, a feeding unit may be additionally provided to feed water or oil used to control heat emitted in the grinding work of the sheet in addition to the grinding powders.

Therefore, a plurality of feeding units may be provided to feed grinding powders corresponding to a plurality of grinding head parts.

Finally, the step of determining if the grounded sheet has the predetermined thickness (S90) may be performed.

According to the present step (S90), when the initial sheet is continuously ground to form the final sheet, a worker may be determine if the sheet reaches a sheet having a required thickness, or if a portion of the sheet is removed by an amount required by the worker.

Hereinafter, the detailed structure of an automatic sheet grinding apparatus 200 will be described below with reference to FIGS. 2, 3, and 5.

FIG. 2 is a side sectional view showing the automatic sheet grinding apparatus according to an exemplary embodiment of the present invention. FIG. 3 is a schematic plan view showing the automatic sheet grinding apparatus shown in FIG. 2 according to an exemplary embodiment of the present invention.

Referring to FIG. 2, the automatic sheet grinding apparatus 200 for automatically grinding the sheet according to an exemplary embodiment of the present invention includes a stationary stage 250 positioned at a lower portion of the automatic sheet grinding apparatus 200, a sheet holder 260 positioned on the stationary stage 250 to grip the sheet 270, and a grinding head part 210 having a chuck assembly 214 fixed thereto through a spindle 212, spaced apart from the sheet holder 260, and having a grinding disc 218 attached to the chuck assembly 214 to grind the sheet 270 which is positioned on the stationary stage 250 and provided in the sheet holder 260.

In this case, the grinding head part 210 may further include a thickness measuring unit 220 to measure the thickness of the sheet 270 and a hardness measuring unit 230 to measure the hardness of the sheet 270.

As shown in FIG. 2, the sheet holder 260 has a concave central portion so that the sheet 270 is griped in the sheet holder 260. The depth of the sheet holder 260 is set lower than the height of the sheet 270 by taking into consideration that the height of the sheet 270 is lowered as the sheet 270 is ground to become the final sheet.

As shown in FIGS. 2 and 3, rails 265 and 267 are located on the stationary stage 250 while extending in parallel to each other.

In this case, the sheet holder 260 is securely located on the rails 265 and 267 on the stationary stage 250 movably left or right.

The left and right movement of the sheet holder 260 is expressed in an arrow (← or →) in FIG. 2.

When the sheet holder 260 is secured movably left and right, the position of the sheet holder 260 may be changed, if necessary, in grounding the sheet 270. Accordingly, the sheet 270 may be ground by rotating the grinding disc 218. In addition, the sheet 270 may be horizontally ground by moving left and right the sheet 270 similarly to the manual grinding by the worker.

However, in this case, instead of the grinding disc 218 employed for the rotation grinding work, a grinding pad such as sandpaper may be attached.

Further, preferably, a drain 252 may be further formed at a lower portion of the stationary stage 250 to drain water or oil. The water or the oil drained from the drain 252 is recycled for the reuse of the drain 252.

According to the present invention, more particularly, an additional ventilation facility (not shown) is provided to preferably control scattered dust created in the grinding work since the high-speed rotational grinding by the grinding disk 218 or the grinding powders can be employed.

Hereinafter, the grinding head part 210 will be described. The grinding head part 210 according to an exemplary embodiment of the present invention is provided at a lower portion thereof with the chuck assembly 214 used to grind the sheet 270.

In the chuck assembly 214, the grinding disc 218 or the grinding pad (not shown) may be attached to a lower portion of a chuck 216.

Those skilled in the art to which the present invention pertains can understand that a motor (not shown) is further provided to rotate, or move up or down the spindle 212 provided in the grinding head part 210.

The grinding head part 210 may further include a display unit 280 to be described, and the display unit 280 will be described below with reference to FIG. 5.

The grinding head part 210 is additionally provided at a lower portion thereof with the thickness measuring unit 220 to measure the thickness of the sheet 270, and with the hardness measuring unit 230 to measure the hardness of the sheet 270.

As described with reference to FIG. 1, the thickness measuring unit 220 and the hardness measuring unit 230 may be used to collect data required for determining the grinding speed in the step of determining the grinding speed (S60).

The total time required for grinding the sheet 270 may be estimated based on the thickness data and the hardness data obtained from the thickness measuring unit 220 and the hardness measuring unit 230.

Further, based on the hardness data obtained from the hardness measuring unit 230, the approaching speed of the chuck assembly 214 to the sheet 270 may be reduced in the case of the sheet 270 having higher hardness. To the contrary, the approaching speed of the chuck assembly 214 to the sheet 270 may be increased in the case of the sheet 270 having lower hardness.

Meanwhile, preferably, the thickness measuring unit 220 and the hardness measuring unit 230 employ an ultrasonic wave-based operation mechanism. A touch rod (not shown) may be moved down to the sheet 270 to measure the thickness and the hardness of the sheet and the ground sheet. In this case, the durability of the automatic sheet grinding apparatus 200 for automatically grinding the sheet may be lowered, so that the touch rod-based scheme is not preferable.

The operation mechanism of the thickness measuring unit 220 and the hardness measuring unit 230 may include a laser-based scheme in addition to an ultrasonic wave-based mechanism. However, when a laser beam is irradiated to the sheet 270, an accident may occur. Accordingly, if the sheet 270 is not protected by a housing (not shown), the irradiation of the laser beam to the sheet 270 is not preferred.

As shown in FIG. 3, the rails 265 and 267 may be paired. As described above, when one pair of rails 265 and 267 are provided, preferable strength can be maintained when the sheet holder 260 is moved in the automatic sheet grinding apparatus 200 for automatically grinding the sheet.

Meanwhile, as shown in FIGS. 2 and 3, the automatic sheet grinding apparatus 200 for automatically grinding the sheet according to an exemplary embodiment of the present invention may further include a water or oil feeding unit 240 or a feeding unit (not shown) to feed grinding powders.

In this case, the water or oil feeding unit 240 may preferably include a flexible pipe.

To this end, a water feeding tank and an oil feeding tank, which are not shown in drawings, may be further installed. Preferably, water and oil may be fed through an additional feeding unit (for example, a pipe similar to that shown in reference numeral 240).

At this time, a pump (not shown) or a motor (not shown) may be additionally installed to feed water or oil.

In addition, as shown in FIG. 3, more preferably, water or oil may be fed to the center of the sheet (not shown in FIG. 3) provided in the sheet holder 260.

Figure 4A:
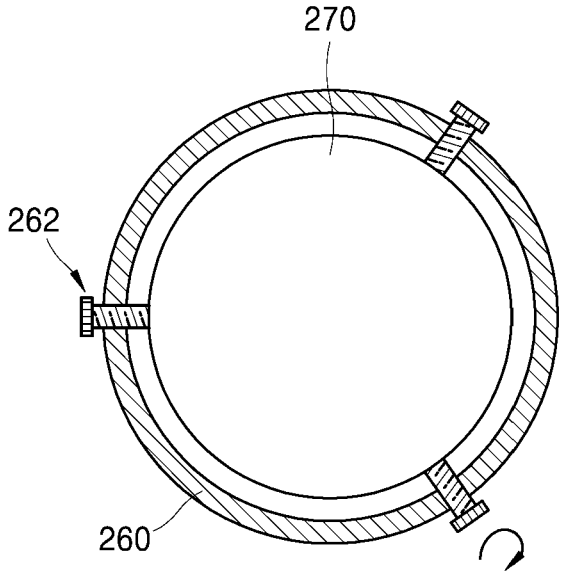
FIGS. 4A and 4B are schematic view showing two types of sheets and two types of sheet holders to grip the sheets according to an exemplary embodiment of the present invention.
Figure 4B:
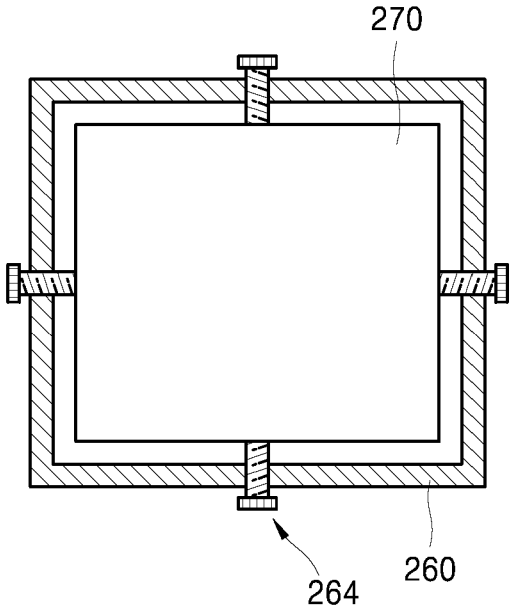

FIGS. 4A and 4B are schematic view showing two types of sheets and two types of sheet holders to grip the sheets according to an exemplary embodiment of the present invention.

Referring to FIGS. 4A and 4B, the sheet 270 may have a circular shape or a rectangular shape. The sheet 270 may be prepared in a rectangular shape. However, the sheet 270 of a boring hole core obtained from a borehole may generally have a circular shape. In addition, even if a metallic rod material is ground, the sheet 270 may have a circular shape.

Meanwhile, preferably, the sheet holder 260 may have a circular shape or a rectangular shape corresponding to the circular shape or the rectangular shape of the sheet 270. The sheet 270 having the circular shape or the rectangular shape is shown in FIG. 4A or 4B, respectively.

FIG. 4A shows the sheet 270 having a circular shape. In order to fix the sheet 270 into the holder 260 and grip the sheet 270, holder gripping parts 262 are provided in at least three parts of the holder 260.

Most preferably, the holder gripping parts 262 are provided in the form of a screw as shown in drawings. Alternatively, the structure that the sheet 270 is gripped using elasticity of an elastic unit, such as a spring, may be provided. However, since the elasticity may be applied to the sheet 270 and may not integrally control the gripping force, the sheet 270 may be damaged in the worst case. Accordingly, the structure is not recommended.

Meanwhile, FIG. 4B shows that the sheet 270 has a rectangular shape. As shown in FIG. 4B, preferably, the sheet 270 may be regarded as having a substantially rectangular shape.

As shown in FIGS. 4A and 4B, preferably, at least three holder gripping parts 262 and 264 are formed in order to firmly grip the sheet 270.

Finally, the display unit formed in the grinding head part of the automatic sheet grinding apparatus shown in FIG. 1 according to one embodiment of the present invention will be described with reference to FIG. 5.

Figure 5:
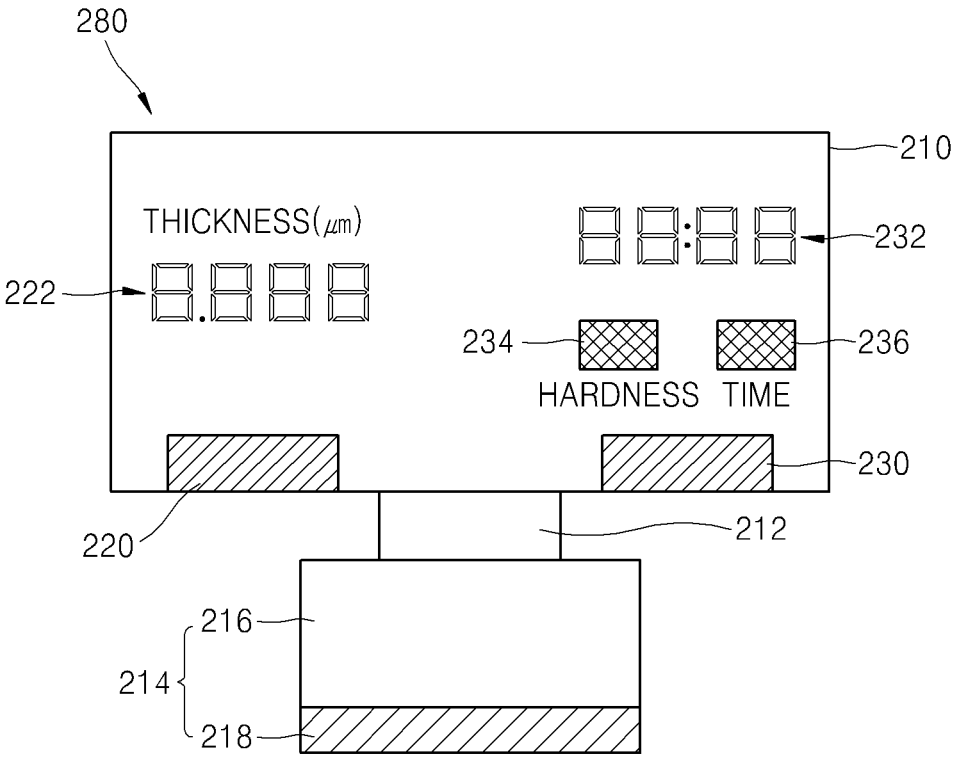
FIG. 5 is a detailed view showing a display unit provided at a grinding head unit in the automatic sheet grinding apparatus shown in FIG. 1 according to an exemplary embodiment.

As shown in FIG. 5, the display unit 280 in the grinding head part 210 includes a thickness display unit 222 to display a measurement result of a thickness of the sheet 270 or an a sheet under the grinding work, which is formed in the process of grinding a sheet, measured by the thickness measuring unit 220 and a hardness display unit 232 to display a measurement result of hardness of the sheet 270 or the sheet under the grinding work, which is formed in the process of grinding the sheet, measured by the hardness measuring unit 230.

In this case, the unit used to display the measurement result of the thickness is preferably at least μm. If necessary, the number below decimal point may be displayed.

In addition, the hardness display unit 232 may serve as a time display unit to display the total time estimated to grind the sheet 270, or the total time required to grind the sheet 270 while displaying the hardness. To this end, a hardness display selection button 234 or a time display selection button 236 may be additionally formed under the hardness display unit 232.

When a worker presses the hardness display selection button 234, the hardness may be displayed on the hardness display unit 232. When the worker presses the time display selection button 236, the total time estimated to grind the sheet 270, or the total time required to grind the sheet 270 may be displayed through a toggling scheme. In this case, the toggling scheme refers to a scheme of displaying the total time estimated to grind the sheet 270 when the worker presses the time display selection button 236 at one time, and of displaying the total time required to grind the sheet 270 when the worker presses the time display selection button 236 once more.

Further, when the worker presses the time display selection button 236, a timer function may be performed, which can be easily realized by those skilled in the art. Accordingly, the details thereof will be omitted.

As described above, the thickness measuring unit 220 and the hardness measuring unit 230 are preferably operated through an ultrasonic wave-scheme. The operating scheme of the thickness measuring unit 220 and the hardness measuring unit 230 is a non-contact operating scheme, which contributes to the improvement of the endurance.

The thickness measuring unit 220 and the hardness measuring unit 230 may measure thickness and hardness of the sheet 270 in real time. For example, as described above, when the sheet 270 has high hardness, that is, the sheet 270 is hard, the rotational speed of the spindle 212 may be reduced and the approaching speed of the spindle 270 to the sheet 270 may be reduced.

Further, the total time estimated to grind the sheet 270 can be estimated from the measurement results of the thickness measuring unit 220 and the hardness measuring unit 230.

The rotational speed of the chuck assembly 214 or the moving speed of the sheet holder 260 on the rails 265 and 267 in a left-right direction may be determined.

The replacement time point of the grinding disc 218 and the supply time point of the grinding powders may be additionally displayed (not shown) based on the total time estimated to grind the sheet 270 and the measurement result of the thickness of the sheet 270. Accordingly, the worker may more flexibly perform the grinding work. For example, the worker may previously prepare resources necessary for the grinding work.

Furthermore, the rotational speed of the chuck assembly 214 may be displayed on the display unit 280. To this end, a button (not shown) similar to the hardness display selection button 234 or the time display selection button 236 may be additionally provided. Alternatively, the rotational speed of the chuck assembly 214 may be constantly displayed on the display unit 280.

Simultaneously, when the chuck assembly 214 grinds the sheet 270, force pressing the sheet 270, that is, pressure may be additionally displayed on the display unit 280.

The force pressing the sheet 270 by the chuck assembly 214 is displayed because the sheet 270 may be damaged when the sheet 270 has lower hardness, for example the sheet 270 is as soft as that of an unsolidified sample, and significantly great force is applied by the chuck assembly 214.

In this case, preferably, the worker should take precaution.

According to an exemplary embodiment of the present invention, since the non-contact hardness measuring unit 230 is installed, the force pressing the sheet 270 by the chuck assembly 214 is accessorily measured.

Finally, the sheet holder 260, which is securely and movably located onto the rails 265 and 267, may be moved left or right when the thickness or the hardness of the sheet 270 is measured. The chuck assembly 214 is moved left or right because the size of the chuck assembly 214 is greater than that of the sheet 270, that is, because the thickness measuring unit 220 and/or the hardness measuring unit 230 installed at a lower portion of the grinding head part 210 may be interrupted by the chuck assembly 214 when measuring the thickness and/or the hardness of the sheet 270.

In order to measure the thickness and/or the hardness of the sheet 270 (or the sheet under the grinding work), following operations are performed. First, when the thickness of the sheet 270 (or the sheet under the grinding work) is measured, the sheet holder 270 on the rails 265 and 267 is appropriately moved left to measure the thickness of the sheet 270 (or the sheet under the grinding work). Next, when the hardness of the sheet 270 (or the sheet under the grinding work) is measured, the sheet holder 270 on the rails 265 and 267 is appropriately moved right to measure the hardness of the sheet 270.

Meanwhile, as described above, if the sheet holder 270 on the rails 265 and 267 is moved left or right, the grinding work may be stopped in the middle of performing the grinding work. Accordingly, although not shown in drawings, to seamlessly perform the grinding work, the thickness measuring unit 220 and/or the hardness measuring unit 230 may be introduced or withdrawn left or right in a diagonal direction from an outside of the grinding head part 210. In other words, the thickness measuring unit 220 and/or the hardness measuring unit 230 may be introduced in a direction of '↘' or withdrawn in a direction of '↗'.

As described above, the introducing or withdrawing structure in the direction of '↘' or '↗' is possible because the thickness measuring unit 220 and/or the hardness measuring unit 230 according to the present invention are operated through an ultrasonic wave scheme.

In other words, those skilled in the art should comprehend that the above-described embodiments are provided for an illustrative purpose in all aspects, and not limited to the above description. The scope of the present invention is limited by appended claims instead of the detailed description. In addition, it will also be apparent to those skilled in the art that variations or modifications from the appended claims and the equivalent concept of the claims are included in the scope of the present invention.

What is claimed is:

1. An automatic sheet grinding apparatus comprising:

a stationary stage positioned at a lower portion of the automatic sheet grinding apparatus;

a sheet holder positioned on the stationary stage to grip a sheet; and a grinding head part having a chuck assembly fixed to the grinding head part through a spindle, spaced apart from the sheet holder, positioned on the stationary stage, and having a grinding disc attached to the chuck assembly to grind the sheet provided in the sheet holder, wherein the grinding head part comprises:

a thickness measuring unit to measure a thickness of the sheet; and a hardness measuring unit to measure hardness of the sheet.

2. The automatic sheet grinding apparatus of claim 1, wherein the sheet has a shape of a circle or a rectangle, and the sheet holder has a shape of a circle or a rectangle corresponding to the shape of the sheet.

3. The automatic sheet grinding apparatus of claim 2, wherein the sheet holder comprises at least three holder gripping parts to grip the sheet.

4. The automatic sheet grinding apparatus of claim 3, wherein the sheet holder is provided at a center thereof with a concave part, and the concave part has a depth less than a thickness of the sheet.

5. An automatic sheet grinding apparatus comprising:

a stationary stage positioned at a lower portion of the automatic sheet grinding apparatus;

rails positioned on the stationary stage and extending in parallel to each other;

a sheet holder securely and movably provided on the rails positioned on the stationary stage to grip the sheet; and a grinding head part having a chuck assembly fixed to the grinding head part through a spindle, spaced apart from the sheet holder, positioned on the stationary stage, and having a grinding disc attached to the chuck assembly to grind the sheet provided in the sheet holder, wherein the grinding head part comprises:

a thickness measuring unit to measure a thickness of the sheet; and a hardness measuring unit to measure hardness of the sheet.

6. The automatic sheet grinding apparatus of claim 5, wherein the sheet has a shape of a circle or a rectangle, and the sheet holder has a shape of a circle or a rectangle corresponding to the shape of the sheet.

7. The automatic sheet grinding apparatus of claim 6, wherein the sheet holder comprises at least three holder gripping parts to grip the sheet.

8. The automatic sheet grinding apparatus of claim 7, wherein the sheet holder is provided at a center thereof with a concave part, and the concave part has a depth less than a thickness of the sheet.

9. The automatic sheet grinding apparatus of claim 1, wherein the grinding head part further comprises a display unit to display a measurement result from the thickness measuring unit and a measurement result from the hardness measuring unit.

10. The automatic sheet grinding apparatus of claim 5, wherein the grinding head part further comprises a display unit to display a measurement result from the thickness measuring unit and a measurement result from the hardness measuring unit.

11. The automatic sheet grinding apparatus of claim 9, wherein the display unit of the grinding head part comprises a time display unit to display total time estimated to grind the sheet, or total time required to grind the sheet.

12. The automatic sheet grinding apparatus of claim 10, wherein the display unit of the grinding head part comprises a time display unit to display total time estimated to grind the sheet, or total time required to grind the sheet.

13. The automatic sheet grinding apparatus of claim 1, further comprising a water or oil feeding unit to control heat emitted when the sheet is ground, or a feeding unit to feed grinding powders.

14. The automatic sheet grinding apparatus of claim 5, further comprising a water or oil feeding unit to control heat emitted when the sheet is ground, or a feeding unit to feed grinding powders.

15. The automatic sheet grinding apparatus of claim 5, wherein the sheet holder, which is securely and movably provided on the rails, moves left or right when the thickness or the hardness of the sheet is measured.

* * * * *